US007297884B2

(12) United States Patent
Shimizu

(10) Patent No.: US 7,297,884 B2
(45) Date of Patent: Nov. 20, 2007

(54) SWITCHING ARRANGEMENT

(75) Inventor: Keiichi Shimizu, Kasugai (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 11/492,657

(22) Filed: Jul. 25, 2006

(65) Prior Publication Data

US 2007/0023261 A1 Feb. 1, 2007

(30) Foreign Application Priority Data

Jul. 29, 2005 (JP) ..... 2005-221020

(51) Int. Cl.
*H01H 9/00* (2006.01)

(52) U.S. Cl. ..... 200/5 R; 200/302.1

(58) Field of Classification Search ..... 200/5 R, 200/293, 302.1–302.3, 4, 1 B, 339, 553, 200/556, 296, 341, 344, 345
See application file for complete search history.

(56) References Cited

U.S. PATENT DOCUMENTS

| | | | | |
|---|---|---|---|---|
| 5,203,448 | A * | 4/1993 | Osada et al. | 200/517 |
| 5,414,231 | A * | 5/1995 | Sato et al. | 200/1 R |
| 5,876,243 | A * | 3/1999 | Sangawa | 439/519 |
| 6,191,372 | B1 * | 2/2001 | Sasaki et al. | 200/1 R |
| 6,610,948 | B1 * | 8/2003 | Tsau | 200/345 |
| 6,911,612 | B2 * | 6/2005 | Seki | 200/339 |
| 7,084,359 | B1 * | 8/2006 | Konno | 200/1 B |
| 7,122,755 | B2 * | 10/2006 | Ito | 200/339 |
| 7,145,090 | B2 * | 12/2006 | Shimizu | 200/302.1 |
| 7,183,510 | B2 * | 2/2007 | Ami et al. | 200/302.3 |
| 2003/0038021 | A1 | 2/2003 | Tsutsui et al. | |

FOREIGN PATENT DOCUMENTS

| | | |
|---|---|---|
| DE | 20208796 U1 | 8/2002 |
| JP | 57-186941 | 5/1981 |
| JP | 6-77127 | 10/1994 |
| JP | 6-77127 U | 10/1994 |
| JP | 3111221 | 9/2000 |

OTHER PUBLICATIONS

European Search Report; dated Dec. 1, 2006; Application No. EP06015095 (5 pages).
Japanese Office Action for Japanese Patent Application No. 2005-221020, Issued May. 15, 2007, and English Translation thereof, 7 pages.

* cited by examiner

*Primary Examiner*—Michael A Friedhofer
(74) *Attorney, Agent, or Firm*—Osha Liang LLP

(57) ABSTRACT

A switching arrangement capable of preventing water from passing through an opening of a cylinder from outside to enter into a casing is disclosed. A switching arrangement includes a switch, a casing in which the switch is accommodated, a cylinder provided on the casing to be opened up and down to be communicated to an interior of the casing, and an operation knob provided to cover the opening of the cylinder, the operation knob being operated to switch the switch on and off, and wherein a step rising toward the cylinder is provided in a position closer to the cylinder than an outer peripheral surface of the operation knob around the cylinder on the casing.

4 Claims, 7 Drawing Sheets

(a)

(b)

SWITCHING ARRANGEMENT

BACKGROUND OF THE INVENTION

1. Field of the Invention

The present invention relates to a switching arrangement, in which an operation knob is operated to switch a switch on and off, and more particular, to a waterproof type switching arrangement to prevent water from entering into a casing.

2. Description of Related Art

A switching arrangement used in window opening and closing devices (power window devices) for automobiles is arranged on an arm rest of a door, a central console, or the like in an automobile. A switch, a circuit board, etc. are accommodated in a casing of the switching arrangement, a cylinder is provided on the casing to be opened up and down to be communicated to an interior of the casing, and an operation knob is provided to cover an upper opening of the cylinder, as disclosed in, for example, Japanese Patent No. 3111221. Operation knobs include ones of various types to enable operations such as push-down, swinging, rotation, or the like. An operation knob is operated whereby movements of the operation knob are transmitted to a switch through an actuator, etc. from the operation knob to switch the switch on and off. That is, a contact provided in the switch is switched over to an ON (conduction) state or an OFF (non-conduction) state according to the operation of the operation knob.

A cover is generally mounted on the switching arrangement to cover an upper surface of the casing, and an operation knob is exposed from a hole provided on the cover to be enabled to operate. Therefore, even when some rainwater splashes on the cover at the time of rainy weather or the like, the rainwater little enters into the casing of the switching arrangement. In the case where a large amount of beverage, etc. (referred below to as "water") spills on the cover, however, the water passes through a clearance between the hole of the cover and the operation knob to flow down the casing to flow toward the cylinder, etc. Water having flown toward the cylinder is caused by its impulse to go up the clearance between the operation knob and the cylinder to pass through an opening of the cylinder to enter into the casing to become responsible for corrosion and short-circuit of the switch and the circuit board.

As measures for prevention of invasion of water described above, according to Japanese Patent No. 3111221, a water catching groove is formed on a casing forwardly and rearwardly of a cylinder, to which a swinging operation type operation knob is mounted, a bottom of the groove is molded to be inclined forwardly of the casing, or a central portion of the groove is molded to be mountain-shaped to have a watershed, and drainage ports are formed on a front surface and a side of the casing to extend into a deepest portion of the water catching groove. Also, a groove with an end thereof opened is formed around that cylinder, to which a push-down operation type operation knob on the casing is mounted.

On the other hand, according to JP-UM-A-6-77127, a stopper is protrusively provided in a button hole formed in a casing in order to prevent malfunctioning of a push-down operation type operation knob, etc. caused by invasion of water into the button hole, an engagement is protrusively provided on an end of that cylinder (holder), which is separate from a casing and provided in the button hole, a back surface of a stopper toward a base thereof is made an abutment for the engagement, and a back surface of a tip end of the stopper is made a non-abutment for the engagement.

Also, a groove is formed around a cylinder, which is provided on the casing to be made integral therewith.

Since according to Japanese Patent No. 3111221 and JP-UM-A-6-77127 described above the groove is formed on the casing to be made adjacent to the cylinder, however, there is a fear that water flowing from outside enters the groove to splash due to an impulse generated when striking against the groove bottom or the like, to go up a clearance between the operation knob and the cylinder to pass through an opening of the cylinder to enter into the casing.

SUMMARY OF THE INVENTION

Hereupon, it is an object of the invention to provide a switching arrangement capable of preventing water from passing through an opening of a cylinder from outside to enter into a casing.

The invention provides a switching arrangement comprising a switch, a casing, in which the switch is accommodated, a cylinder provided on the casing to be opened up and down to be communicated to an interior of the casing, and an operation knob provided to cover the opening of the cylinder, the operation knob being operated to switch the switch on and off, and wherein a step rising toward the cylinder is provided in a position closer to the cylinder than an outer peripheral surface of the operation knob around the cylinder on the casing.

In this manner, a step is provided around the cylinder on the casing whereby water flowing to the vicinity of the operation knob on the casing from outside can be stopped and prevented by the step from flowing toward the cylinder. Also, since the step and the upper portion of the step are positioned toward the cylinder relative to the outer peripheral surface of the operation knob, water flowing to the vicinity of the operation knob on the casing from outside does not flow directly to the upper portion of the step without passing through the lower portion of the step and the step. Therefore, water can be prevented from passing through the opening of the cylinder from outside to enter into the casing.

Also, according to an embodiment of the invention, a groove is provided around the cylinder on the casing to be contiguous to a side of the casing nearby, an end thereof toward the side being opened and the step is provided in the groove.

In this manner, the step is provided in the groove provided on the casing whereby water flowing to the vicinity of the operation knob on the casing from outside can be prevented by the step from entering below the lower portion of the step in the groove to flow toward the cylinder from the lower portion and the water can be discharged laterally of the casing through the opened end of the groove without staying on the lower portion of the step in the groove, thus enabling further preventing water from entering into the casing.

Also, according to an embodiment of the invention, there is provided a cover mounted to cover an upper surface of the casing and having a hole to expose the operation knob to enable operation of the same, and an opposite end of the groove to the cylinder is positioned to be more distant from the cylinder than an end of the hole of the cover toward the cylinder.

With such construction, since the groove and the lower portion of the step are positioned just below the clearance between the cover and the operation knob, water passing through the clearance to flow down can be caused to directly enter the lower portion of the step in the groove to be discharged laterally of the casing from the opened end of the groove, thus enabling further preventing water from entering into the casing.

Further, according to an embodiment of the invention, a bottom of the groove is inclined downward toward the side of the casing nearby.

With such construction, water entering the lower portion of the step in the groove can be caused to flow along the bottom of the groove at any time without staying on the lower portion and to be discharged smoothly laterally of the casing from the opened end, thus enabling further preventing water from entering into the casing.

According to the invention, water flowing to the vicinity of the operation knob on the casing from outside surely enters the lower portion of the step and can be stopped and prevented by the step from flowing toward the upper portion of the step and the cylinder therebeyond from the lower portion, so that it is possible to prevent water from passing through the opening of the cylinder from outside to enter into the casing.

DESCRIPTION OF PREFERRED EMBODIMENTS

Figure 1:
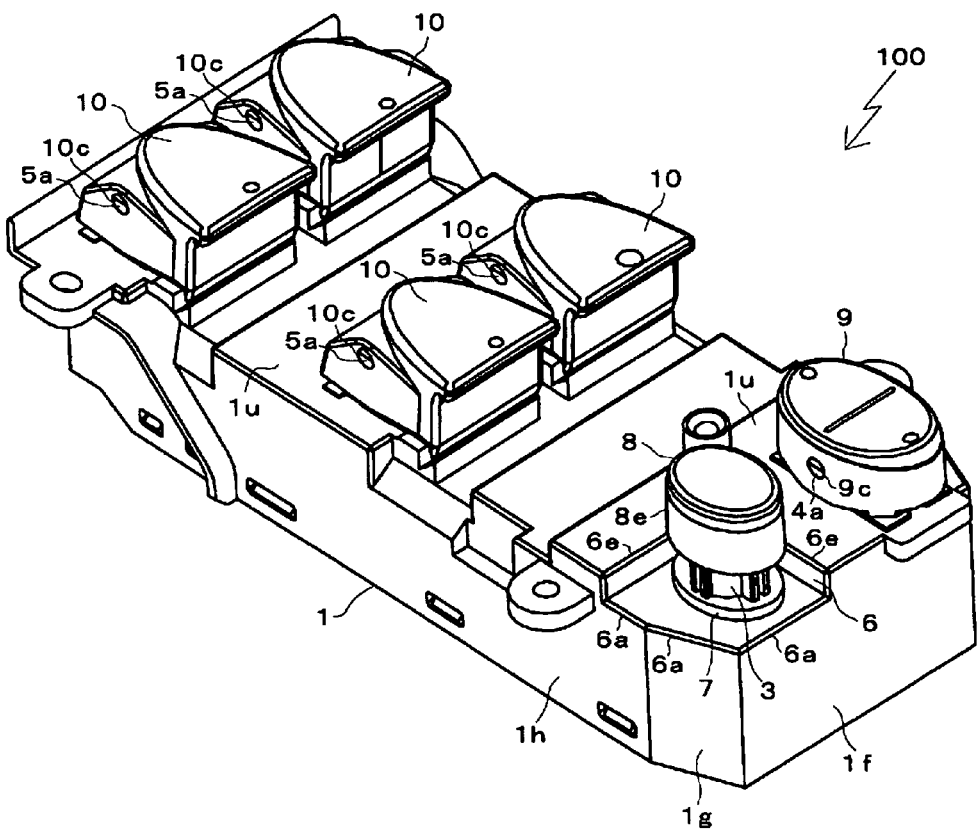
FIG. 1 is a perspective view showing a switching arrangement according to an embodiment of the invention.
Figure 2:
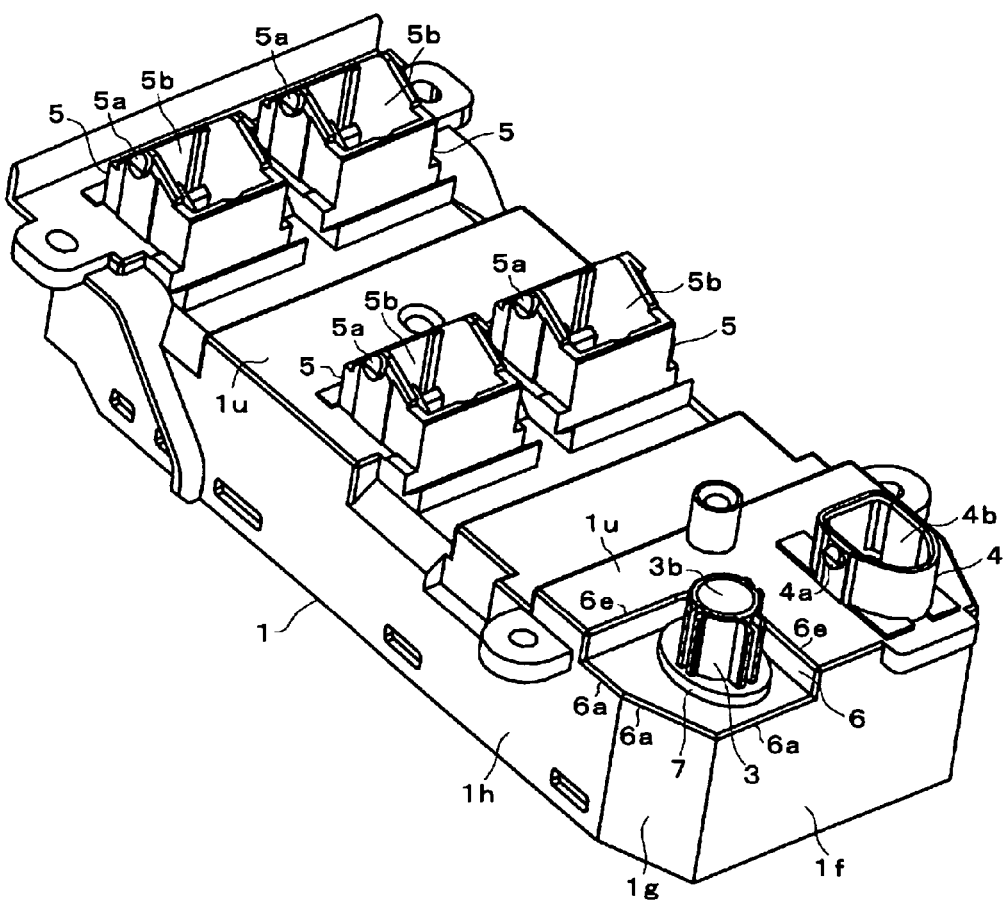
FIG. 2 is a perspective view showing a casing of the switching arrangement.
Figure 3:
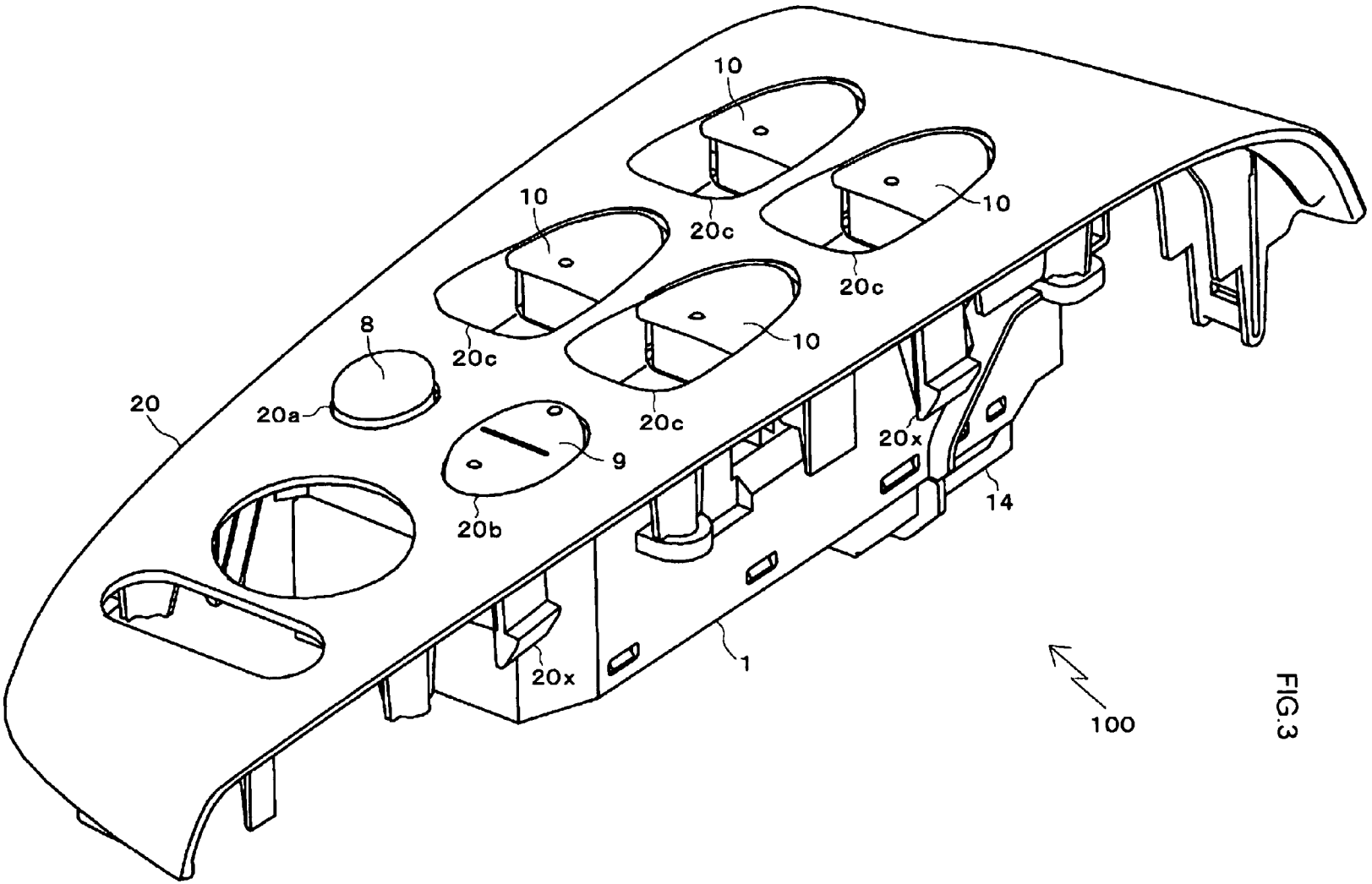
FIG. 3 is a perspective view showing a state, in which a cover is mounted on the switching arrangement.

Embodiments of the invention will be described below with reference to the drawings. FIG. 1 is a perspective view showing a switching arrangement 100 according to an embodiment of the invention, FIG. 2 is a perspective view showing a casing of the switching arrangement 100, FIG. 3 is a perspective view showing a state, in which a cover 20 is mounted on the switching arrangement 100, FIG. 4 is a side, cross sectional view showing the state, FIG. 5 is a side view showing an essential part of the state, and FIGS. 6A and 6B are side, cross sectional views showing an essential part of the state.

In FIG. 1 or the like, the switching arrangement 100 is used in a power window device and mounted to an arm rest (depiction thereof being omitted) provided on a door about a driver's seat of a vehicle. The reference numeral 1 denotes a casing of the switching arrangement 100. Cylinders 3 to 5 opened up and down and communicated to an interior of the casing 1 are provided on an upper surface 1*u* of the casing 1 to be made integral with the casing 1 as shown in FIGS. 2, 4, and the like. Accommodated in the casing 1 as shown in FIG. 4 or the like are a circuit board 11 and switches 12, 13, etc. mounted on the circuit board 11. An underside of the casing 1 is opened and closed by fitting a lower cover 2 thereon. A connector 14 projecting downward from the lower cover 2 is mounted on the circuit board 11. A cable for connection to a controller (not shown) is fitted into the connector 14 to enable transmitting output signals of the switches 12, 13, etc. from the switching arrangement 100 to the controller. A cover 20 is mounted to the casing 1 by means of screws (depiction thereof being omitted) as shown in FIGS. 3 and 4, and the upper surface 1*u* of the casing 1 is covered by the cover 20. The cover 20 is mounted by having hook pieces 20*x* caught by the arm rest of the door.

Figure 4:
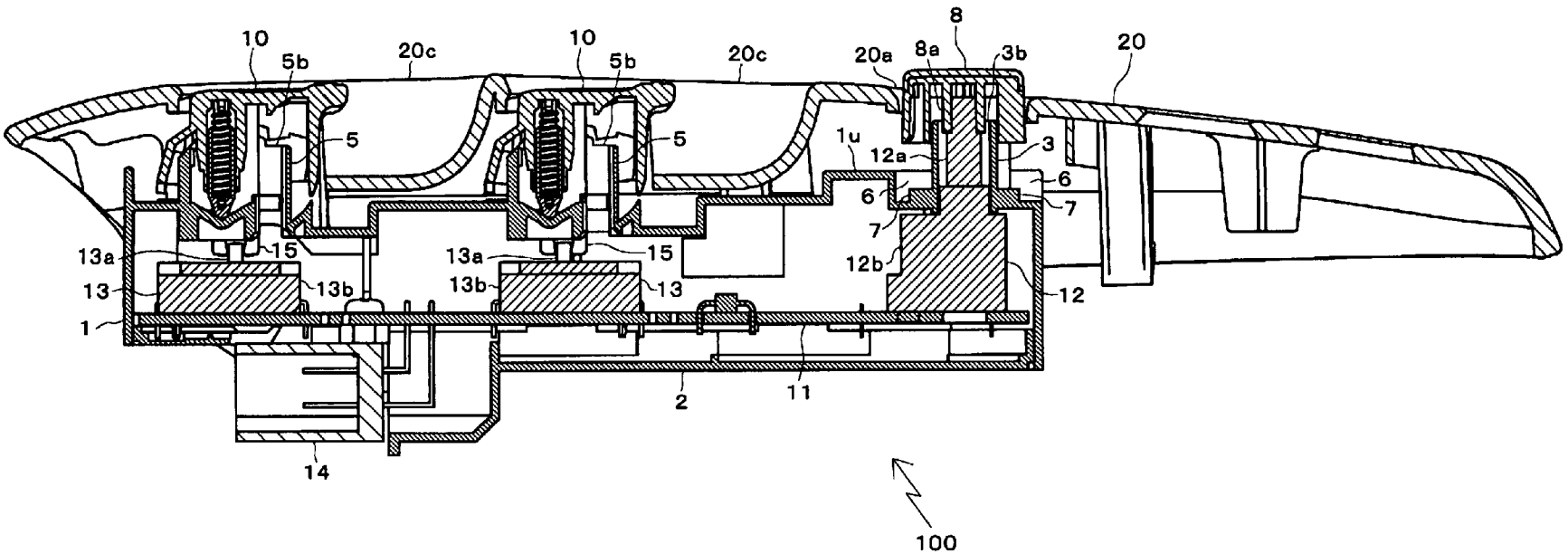
FIG. 4 is a side, cross sectional view showing the state.
Figure 5:
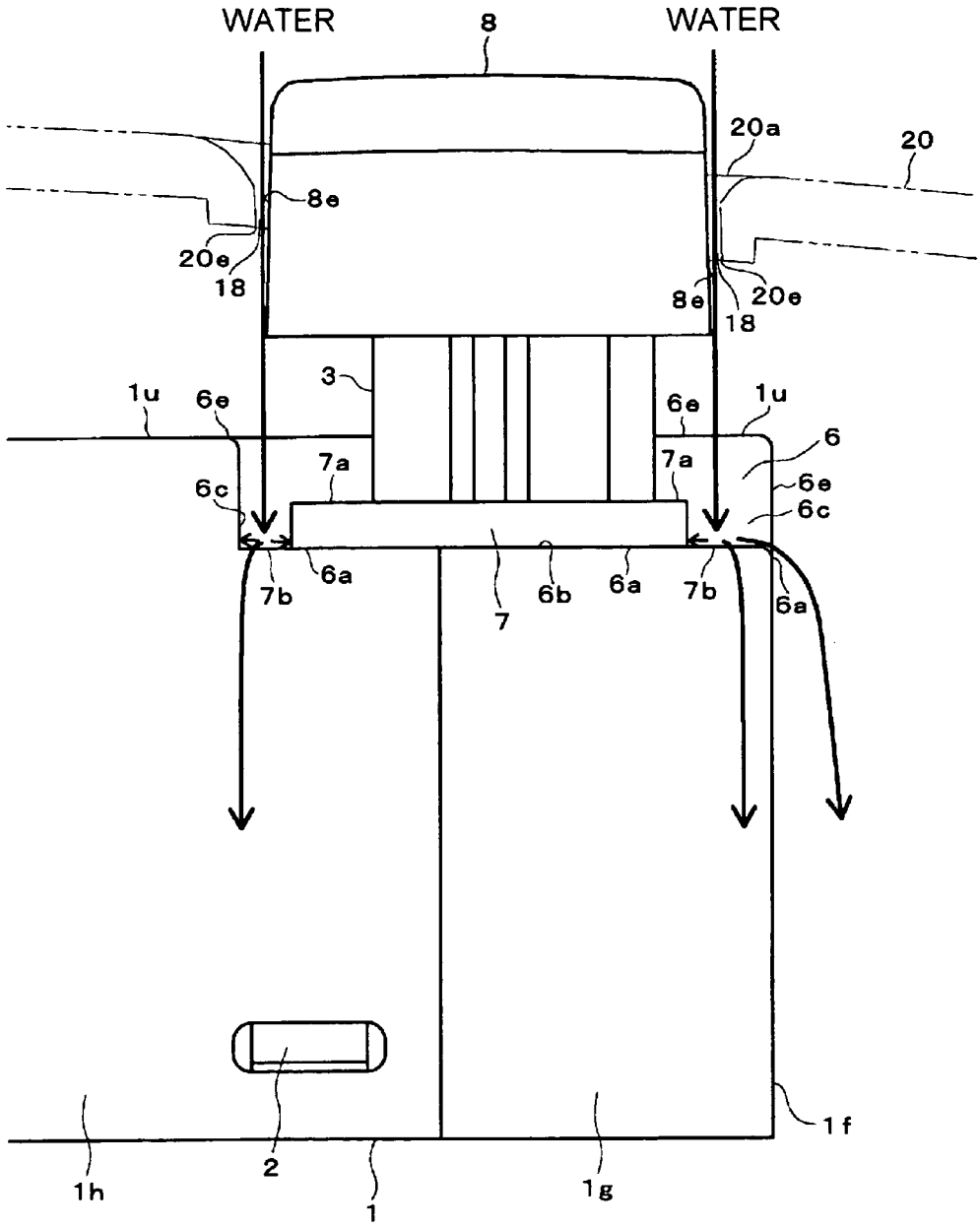
FIG. 5 is a side view showing an essential part of the state.
Figure 6:
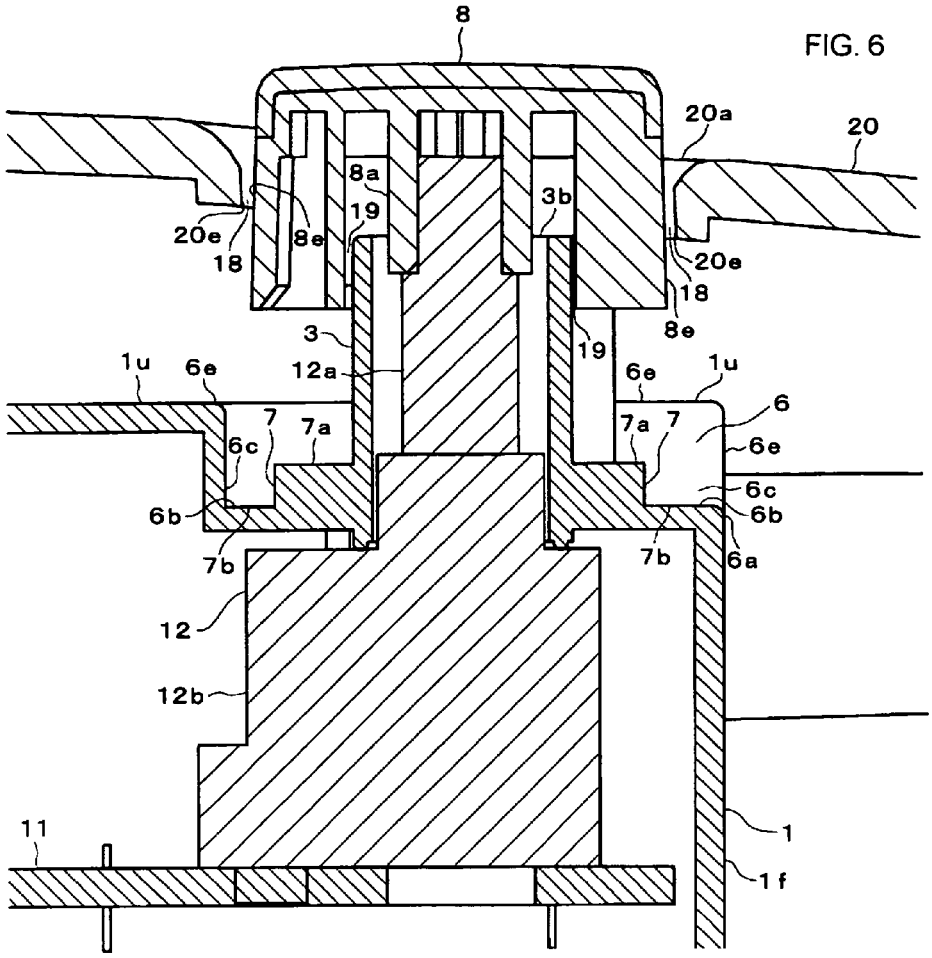
FIGS. 6A and 6B are side, cross sectional views showing an essential part of the state.
Figure 6:
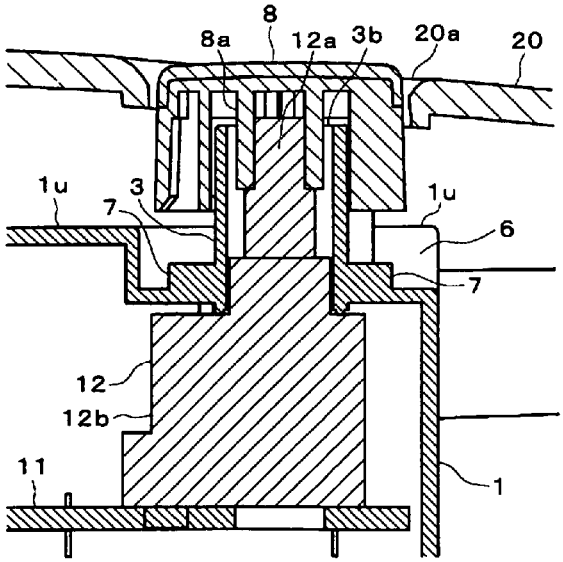

As shown in FIGS. 1, 4, and 6, a push-down operation type operation knob 8 for a window lock switch is provided on the cylinder 3 in a manner to cover an upper opening 3*b* of the cylinder 3. More specifically, by fitting a tip end portion of an actuator 12*a* of a switch 12, which extends through the cylinder 3, into a cylindrical-shaped, fitted portion 8*a* (FIGS. 6A and 6B) integrally and protrusively formed inside the operation knob 8, the operation knob 8 is supported on an upper portion of the cylinder 3 to be able to move up and down. The operation knob 8 is locked so as not to enable opening and closing a window of a vehicle, or operatively pushed down to release such locking. The switch 12 is one for window locking and constituted by a known lock type push switch.

Therefore, when the operation knob 8 is once operatively pushed down by a finger from an initial state shown in FIGS. 4 and 6A, the actuator 12*a* of the switch 12 is pushed into a body 12*b* to be fixed in the pushed state as shown in FIG. 6B and the operation knob 8 is fixed in a state of push-down operation. When the operation knob 8 is again operatively pushed down by a finger from the fixed state, fixation of the actuator 12*a* is released, the actuator 12*a* is caused by an elastic force of a spring (not shown) provided in the body 12*b* to project at its maximum from within the body 12*b*, and the actuator 12*a* and the operation knob 8 return to an initial state as shown in FIGS. 4 and 6A. Also, in a state, in which the actuator 12*a* is pushed down to be fixed, a contact (not shown) provided in the body 12*b* of the switch 12 is put in an ON (conduction) state, and in a state, in which push-down and fixation are released, the contact is put in an OFF (non-conduction) state. That is, the switch 12 is switched on and off according to an operated position of the operation knob 8.

As shown in FIGS. 1 and 4, an operation knob 9 of a type for swinging and operation of the door lock switch is provided on the cylinder 4 in a manner to cover an upper opening 4*b* of the cylinder 4, and operation knobs 10 of a type for swinging and operation of window opening and closing switches are provided on the cylinders 5 in a manner to cover upper openings 5*b* of the cylinders 5. More specifically, the respective operation knobs 9, 10 are put on the respective cylinders 4, 5 from above and holes 9*c*, 10*c* (FIG. 1) formed on left and right sides of the respective operation knobs 9, 10 are fitted onto shafts 4*a*, 5*a* (FIG. 2) protrusively provided on left and right outer sides of the respective cylinders 4, 5 whereby the respective operation knobs 9, 10 are supported on the respective cylinders 4, 5 to be able to swing both back and front about the shafts 4*a*, 5*a*. The operation knob 9 is locked so as not to enable opening and closing a door of a vehicle, or operatively pushed down to release such locking. The operation knobs 10 are operatively pushed down to open and close the windows of the vehicle. The switches 13 for window opening and closing are provided in the casing 1 as shown in FIG. 4 to correspond to the respective operation knobs 10, these switches being constituted by a known slide switch. Operation rods 15 are integrally and protrusively formed inside the respective operation knobs 10, the operation rods 15 extending through the upper openings 5*b* of the cylinders 5 from the operation knobs 10 to extend into the casing 1 to be fitted into actuators 13*a* of the respective switches 13. In addition, while being not shown in FIG. 4, the operation knob 9 is also provided with a switch for door lock, which is constituted by a slide switch corresponding thereto, and an operation rod protrusively formed inside the operation knob 9 extends through the upper opening 4*b* of the cylinder 4 to extend into the casing 1 to be fitted into an actuator of the switch for door lock.

Therefore, when the operation knobs 10 are brought down forward or raised up rearward by a finger from a neutral condition shown in FIG. 4 to be operatively swung, the operation knobs 10 turn forward and rearward about the shafts 5*a*, and the operation rods 15 transmit such movements to the actuators 13*a*, so that contacts (not shown) provided in bodies 13*b* of the switches 13 are switched over to ON (conduction) or OFF (non-conduction) state. That is, the corresponding switches 13 are switched on and off according to operated positions of the operation knobs 10. The same is with the operation knobs 9.

In a state, in which the cover 20 is mounted to the casing 1, the respective operation knobs 8 to 10 are exposed from holes 20*a* to 20*c* provided on the cover 20 as shown in FIG. 3 and can be operated by a finger. Since the operation knobs 8, 9 can be operated only by pushing them from above, the holes 20*a*, 20*b* are small in opened area, and since the operation knobs 10 are operated by holding a finger thereon to bring them down forward or to raise them up, the holes 20*c* are large in opened area to enable insertion of a finger thereinto.

A groove 6 is provided around the cylinder 3 on the casing 1 to extend all around a whole periphery of the cylinder 3 as shown in FIG. 2 or the like. The groove 6 is contiguous to a forwardly facing side 1*f* of the casing 1 and sides 1*g*, 1*h* of the casing facing leftward in FIG. 2 to be respectively opened at ends 6*a* thereof on the sides 1*f* to 1*h*. Opposite ends 6*e* of the groove 6 to the cylinder 3 are positioned more distant from the cylinder 3 than an end 20*e* of the hole 20*a* of the cover 20 toward the cylinder 3 as shown in FIGS. 5 and 6. Provided in the groove 6 is a step 7 extending around the whole periphery of the cylinder 3 to rise toward the cylinder 3 as shown in FIG. 2 or the like. The step 7 is positioned more close to the cylinder 3 than an outer peripheral surface 8*e* of the operation knob 8, and an upper portion 7*a* and a lower portion 7*b* of the step 7 are positioned below the upper surface 1*u* of the casing 1 as shown in FIGS. 5 and 6. The lower portion 7*b* of the step 7 is consistent (that is, positioned on the same plane) with a bottom 6*b* of the groove 6.

With the switching arrangement 100 constructed in the above manner, when rainwater entering from a window left open and beverage, etc. (referred below to as "water") mistakingly spilt flow to the hole 20*a* of the cover 20, the water passes through a clearance 18 between the cover 20 and the operation knob 8 to flow down the casing 1 as indicated by arrows in FIG. 5. The flowing water enters the lower portion 7*b* of the step 7 in the groove 6 just therebelow and a major part of the water is discharged laterally of the casing 1 from the opened ends 6*a* of the groove 6 as indicated by thick arrows in FIG. 5. Also, a part of the water flows toward the cylinder 3, as indicated by thin arrows in FIG. 5, due to an impulse generated when it falls on and strikes against the lower portion 7*b* of the step 7 but the water is repelled by the step 7 to flow on the lower portion 7*b* of the step 7 to be discharged laterally of the casing 1 from the opened ends 6*a* of the groove 6 without going up the step 7 and reaching the upper portion 7*a* and the cylinder 3. Further, while a part of the water is possibly caused by the impulse to flow to an opposite side to the cylinder 3 as indicated by thin arrows, the water is repelled by an opposite side 6*c* of the groove 6 to the cylinder 3 to flow on the lower portion 7*b* of the step 7 to be discharged laterally of the casing 1 from the opened ends 6*a* of the groove 6 without reaching the upper surface 1*u* of the casing 1.

As described above, the step 7 is provided around the cylinder 3 on the casing 1, so that even when water from outside passes through the clearance 18 between the cover 20 and the operation knob 8 to flow down the vicinity of the operation knob 8 on the casing 1, the step 7 stops the water to enable preventing the same from flowing toward the cylinder 3. Also, since the step 7 and the upper portion 7*a* of the step 7 are positioned toward the cylinder 3 relative to the outer peripheral surface 8*e* of the operation knob 8, water flowing down from the clearance 18 does not flow directly to the upper portion 7*a* of the step 7 without passing through the lower portion 7*b* of the step 7 and the step 7. Therefore, water coming from outside can be prevented from going up the cylinder 3 to pass through a clearance 19 (FIG. 6A) between the operation knob 8 and the cylinder 3 and through the upper opening 3*b* of the cylinder 3 to enter into the casing 1.

Also, since the step 7 is provided in the groove 6 on the casing 1, water flowing down from the clearance 18 can be prevented by the step 7 from entering the lower portion 7*b* of the step 7 in the groove 6 and flowing toward the cylinder 3 from the lower portion 7*b* without flowing on the upper surface 1*u* of the casing 1, and the water can be immediately discharged laterally of the casing 1 from the opened ends 6*a* of the groove 6 contiguous to the sides 1*f* to 1*h* of the casing 1 nearby without staying on the lower portion 7*b* of the step 7 in the groove 6. Therefore, water can be further prevented from entering into the casing 1.

Further, the ends 6*e* of the groove 6 opposed to the cylinder 3 are positioned more distant from the cylinder 3 than the end 20*e* of the hole 20*a* of the cover 20 toward the cylinder 3, whereby the groove 6 and the lower portion 7*b* of the step 7 are positioned just below the clearance 18 between the cover 20 and the operation knob 8, so that water passing through the clearance 18 to flow down can be caused to directly enter the lower portion 7*b* of the step 7 in the groove 6 to be discharged laterally of the casing 1 from the opened ends 6*a* of the groove 6, thus enabling further preventing water from entering into the casing 1.

Figure 7:
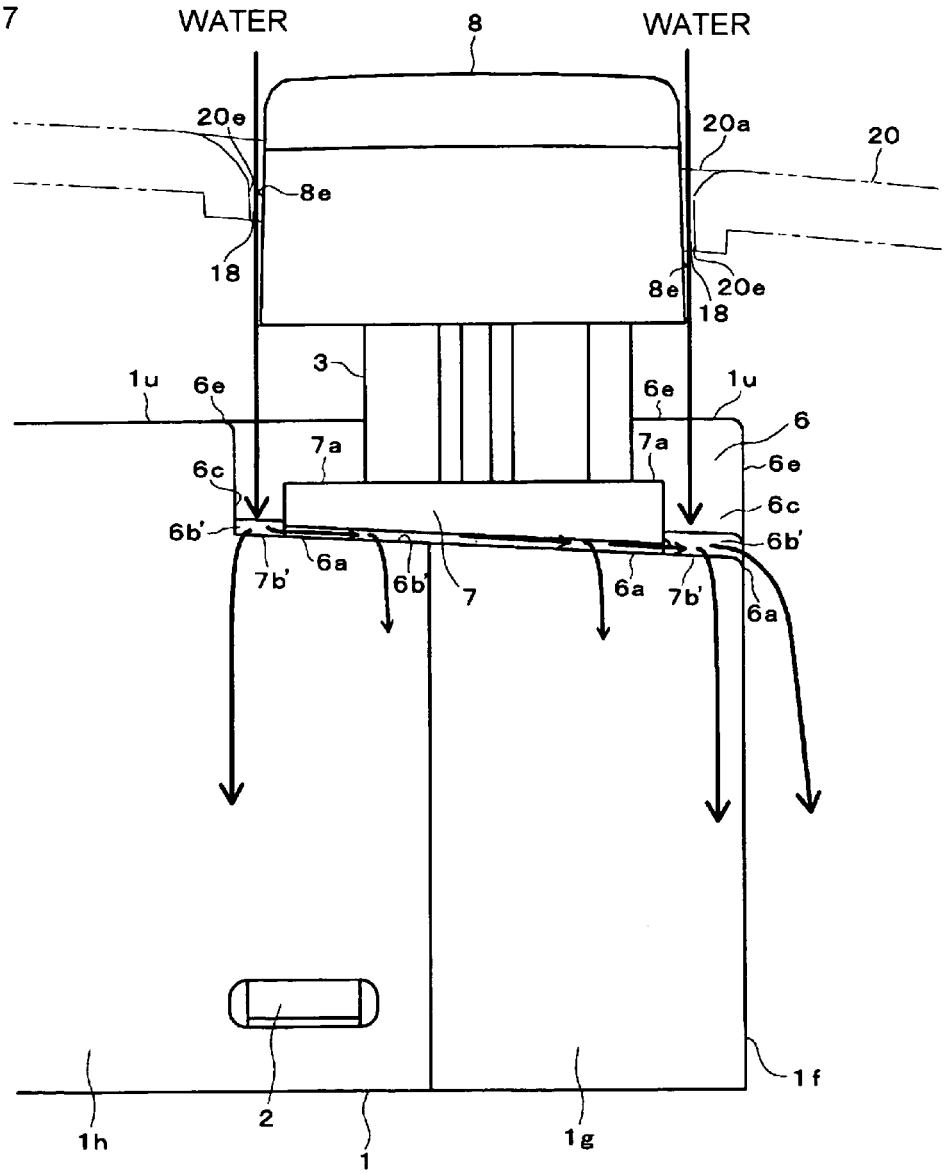
FIG. 7 is a view showing a further embodiment.

While the embodiment described above has given an example, in which the bottom 6*b* of the groove 6 is in parallel to the upper surface 1*u* of the casing 1 and horizontal as shown in FIG. 5 or the like, a bottom 6*b*' of a groove 6 may be inclined downwardly toward sides 1*f* to 1*h* of a casing 1 nearby as shown in FIG. 7. By doing this, water passing through the clearance 18 between the cover 20 and the operation knob 8 to enter a lower portion 7*b*' of the step 7 in the groove 6 can be caused to flow along the bottom 6*b*' of the groove 6 at any time without staying on the lower portion 7*b*' and to be discharged smoothly laterally of the casing 1 from the opened ends 6*a*, thus enabling further preventing water from entering into the casing 1.

Also, while the embodiment described above has given an example, in which the groove 6 and the step 7 are provided around the cylinder 3, on which the push-down operation type operation knob 8 is provided, on the casing 1, similar grooves and similar steps may be provided around cylinders, on which swinging operation type operation knobs are arranged, such as the cylinders 4, 5, to which the operation knobs 9, 10 are mounted, and similar grooves and similar steps may be provided around cylinders, on which rotating operation type operation knobs for mirror control switches are arranged. That is, the invention is applied to enable preventing water from entering in the casing from openings of those cylinders, on which operation knobs of push-down operation type, swinging operation type, rotating operation type, or the like are arranged.

Further, while the embodiment described above has given an example, in which the invention is applied to the switching arrangement 100 used in power window devices, the invention can also be applied to a switching arrangement used in door opening and closing devices, etc., and can also be applied to a switching arrangement used in uses other than vehicle-mount applications.

What is claimed is:

1. A switching arrangement comprising:

a switch, a casing in which the switch is accommodated, a cylinder provided on the casing to be opened up and down to be communicated to an interior of the casing, and an operation knob provided to cover the opening of the cylinder, the operation knob being operated to switch the switch on and off, and wherein a step rising toward the cylinder is provided in a position closer to the cylinder than an outer peripheral surface of the operation knob around the cylinder on the casing, further comprising a groove provided around the cylinder on the casing to be contiguous to a side of the casing nearby, an end thereof toward the side being opened and the step is provided in the groove.

2. The switching arrangement according to claim 1, further comprising a cover mounted to cover an upper surface of the casing and having a hole to expose the operation knob to enable operation of the same, and wherein an opposite end of the groove to the cylinder is positioned to be more distant from the cylinder than an end of the hole of the cover toward the cylinder.

3. The switching arrangement according to claim 2, wherein a bottom of the groove is inclined downward toward the side of the casing nearby.

4. The switching arrangement according to claim 1, wherein a bottom of the groove is inclined downward toward the side of the casing nearby.

* * * * *